US006264569B1

(12) United States Patent
Cannavino

(10) Patent No.: US 6,264,569 B1
(45) Date of Patent: Jul. 24, 2001

(54) POSTING TROT AND CANTER SIMULATOR FOR HORSEBACK RIDERS

(76) Inventor: Diane T. Cannavino, 1137 Arnold Dr., Endicott, NY (US) 13760

( * ) Notice: Subject to any disclaimer, the term of this patent is extended or adjusted under 35 U.S.C. 154(b) by 0 days.

(21) Appl. No.: 09/448,743

(22) Filed: Nov. 24, 1999

Related U.S. Application Data

(60) Provisional application No. 60/111,927, filed on Dec. 11, 1998, now abandoned.

(51) Int. Cl.[7] ..... A63G 13/08

(52) U.S. Cl. ..... 472/95; 472/105; 472/110

(58) Field of Search ..... 472/95, 99, 103, 472/104, 105, 106, 108, 113, 110; 434/247

(56) References Cited

U.S. PATENT DOCUMENTS

| | | | | |
|---|---|---|---|---|
| 1,890,699 | * | 12/1932 | Shoemaker | 472/103 |
| 2,622,878 | * | 12/1952 | Mooney | 472/105 |
| 3,224,723 | * | 12/1965 | Moore | 472/105 |
| 3,292,924 | * | 12/1966 | Wormser et al. | 472/113 |
| 3,390,879 | * | 7/1968 | French | 472/113 |
| 3,672,075 | | 6/1972 | Eikelenboom . | |
| 3,738,671 | | 6/1973 | Czepiga . | |
| 4,341,377 | * | 7/1982 | Ahrens | 472/106 |
| 4,957,444 | | 9/1990 | Armen . | |
| 4,988,300 | | 1/1991 | Yamaguchi . | |
| 5,085,425 | | 2/1992 | Collins . | |
| 5,429,515 | | 7/1995 | Greenwood . | |

* cited by examiner

*Primary Examiner*—Kien T. Nguyen

(57) ABSTRACT

A hobby horse device wherein the diagonal movement and the vertical movement produced in the back of a horse as he trots and canters is simulated so that a rider can exercise and practice performing riding skills. The hobby horse includes a plurality of seat supports with handles. Straps are attached to the base of the seat supports which encompass a support dowel which lies adjacent to the seat supports. The support dowel is attached on both sides to a basic frame by a plurality of springs. The basic frame contains a form representing the horses girth and stirrups for the rider's feet. The extension of the springs and their subsequent return to their original shape provide the vertical movement as the rider presses down and rises with his/her seat. The diagonal movement is produced beneath the rider's seat when the rider raises and lowers each seat support independently of the other. The seat supports also allow for turning, half-halting and halting in response to the rider's body position and use of aids.

3 Claims, 9 Drawing Sheets

FIG. 9
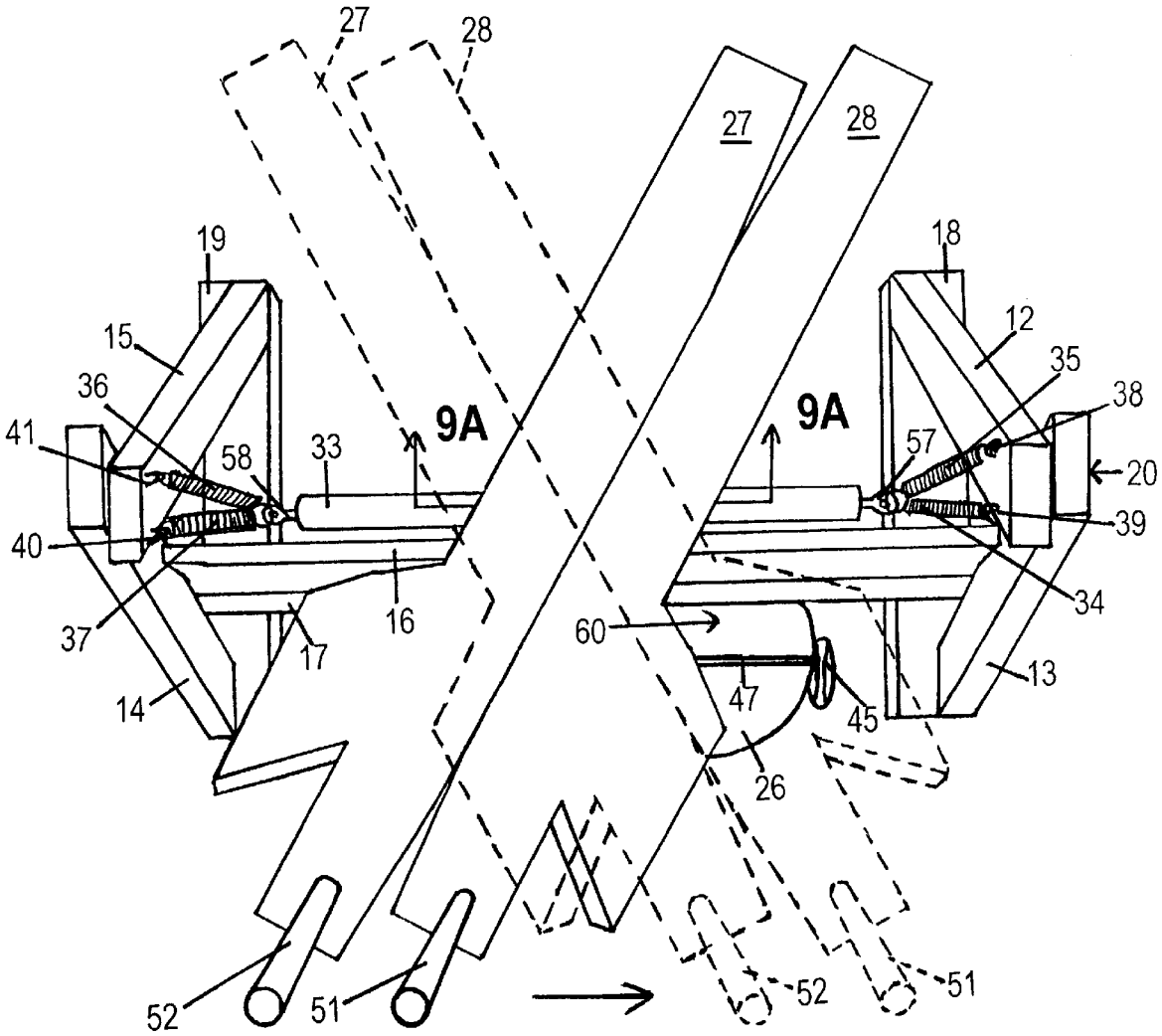
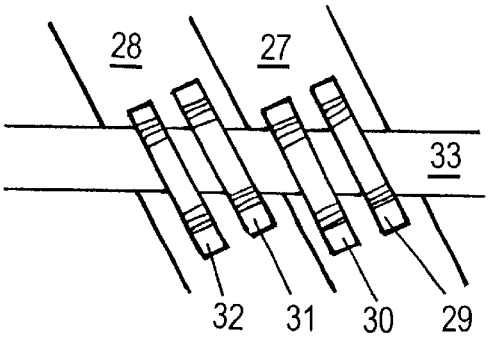
FIG. 9A

POSTING TROT AND CANTER SIMULATOR FOR HORSEBACK RIDERS

CROSS-REFERENCE TO RELATED APPLICATIONS

Provisional Patent Application No. 60/111,927; filing date Dec. 11, 1998 now abandoned.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF INVENTION

This present invention relates to exercise and amusement devices. More particularly, the present invention relates to a riding apparatus such as a hobby horse.

At the present time the general method for a person to learn and practice posting the trot and cantering, which are horseback riding techniques, is to ride a horse. However, individuals interested in learning to ride may not have a horse available with which to practice, and individuals who own a horse may not be able to practice because of bad weather, ailments sustained by their horse or any other number of reasons. Furthermore, beginning riders need many hours of practice to perfect their balanced position at the posting trot and canter so that they can ride with a safe and secure seat. The disadvantage of having only real horses available for the beginner is that because of the beginner's lack of skill, he or she is at a greater risk of falling off the horse and possibly sustaining injuries.

The present invention, however, fills a need for individuals who wish to practice their posting trot and cantering riding skills without having to ride a horse. The present invention can be used so that beginners can more quickly develop and strengthen the muscles used to ride a horse and improve their balance so that they may ride with a safer and securer seat.

Many different types of hobby horses have been developed over the years. The majority utilize an artificial horse body either suspended from a frame by four springs, or an artificial horse body having rockers or wheels attached at the base. The movement produced in the seat of the rider by these hobby horses is quite different from the movement produced by a real horse. Hobby horse devices are usually restricted to providing the rider with either a vertical movement, a longitudinal movement or a circular movement in that there is a combination of a vertical movement and a longitudinal movement in some devices. These hobby horse devices do not simulate the movement of a real horse when it trots or canters. It can be said that these types of prior art hobby horse devices are used as playing machines for children and have never functioned as such to providing real riding movements.

Other types of hobby horse devices specifically claim horse movement simulation. For example, U.S. Pat. No. 4,957,444 to Armen discloses a device to teach handicapped children to perform stops, turns and to apply pressure as in posting. The device includes a saddle, pivoting head assembly, reins, bit simulator and pressure sensitive switches. This device however, provides no movement beneath the rider.

U.S. Pat. No. 3,738,671 to Czepiga discloses an equestrian toy for exercise, development of coordination and entertainment. The device is actuated by the rider through the agency of fore and aft members pivotally attached to a body member for galloping movements in either a forward or rearward direction. Movement is produced by the rider's forward and backward leaning which controls the position of the tiltable seat. This device is meant for a child's amusement. This device may provide a movement that simulates galloping but it does not provide movement that simulates trotting.

U.S. Pat. No. 3,672,075 to Eikelenboom discloses a device which includes the trunk, head and neck of a horse. A saddle for the rider and a chest widening means is also provided. The device provides for training and exercise with respect to the mechanical athletic side of horsemanship except for displacement and speed. This device however, provides only forward and backward movements which may relate to cantering or galloping. Additionally, the forward and backward movement is generated by a motor.

U.S. Pat. No. 4,988,300 to Yamaguchi discloses a device which includes an artificial horse body, with devices which allow it to move in vertical and longitudinal directions. This device enables the rider to give aids to the horse body so that the basic stepping actions of a real horse can be simulated. This device incorporates a barrel which represents the horse body. The horse body carries out rolling, pitching and yawing movements. Since the one piece seat support is restricted to moving as a unit the diagonal movement required for the simulation of a horse's trot is not provided.

U.S. Pat. No. 5,085,425 to Collins discloses a device which simulates the natural cantering movement of a polo pony operated by an electric motor. This device also allows for alteration of the longitudinal/vertical action of the drive means so that the body portion may simulate a different type of horse movement. This device simulates the cantering movement but does not simulate the trotting movement of a horse.

U.S. Pat. No. 5,429,515 to Greenwood discloses a device with a neck portion pivotally mounted to a body portion which simulates horse movements and has powered means. This device more specifically provides an orbital motion of the body portion at its rear end. Additionally, the front part of the body portion tends to swing which more closely simulates a diagonal movement produced in the front portion of a horse's back while galloping. This device simulates galloping and/or cantering but does not simulate the trotting movement.

These exercise and/or amusement devices provide an artificial horse body and/or a saddle for the rider support. The one piece seat support is limited to providing vertical, longitudinal or circular movements into the seat of the rider.

As can be evidenced by a review of the prior art of claimed riding simulators, they provide the rider with vertical, longitudinal and circular movements transmitted from the horse's back into the seat of the rider. These devices do not provide the diagonal movement required for the trot. The vertical and longitudinal movements may to some extent simulate the canter and gallop. Also, when a stationary riding device provides a rider with longitudinal movements, a backward movement occurs which is unnatural. The longitudinal movement is not a requirement for simulating the posting trot and canter motion. The same movements produced in the back of a horse as he trots and canters would be produced even if the horse were trotting or cantering in place.

On the other hand, the diagonal movement is crucial to a realistic simulation of a horse's trot and canter. As a horse trots, his back rises and falls across the diagonals running between his shoulders and hips. When a horse canters, his back creates a seesawing movement from the shoulder to the hips, but at the same time a diagonal rise will be felt when the non-leading front leg and opposite back leg land on the ground at the same time. For a realistic simulation of the trot and canter, a rider needs to be provided with the diagonal and vertical movements produced in the horse's back when he trots or canters. A solid one piece structure representing the seat support in a riding device cannot provide the alternating diagonal movement required for simulation of a horse's trot. A solid one piece seat support is restricted to moving as one unit.

Except Czepigats device, none of the other stationary devices which provide movement beneath the rider are self operable by the rider. The rider must rely on movements generated by a motor. The rider does not have complete control over the speed of the movements produced beneath his/her seat.

In the prior art, halting and half-halting aids applied by the seat and thighs of the rider are not responded to by the seat support of the device. Rather the prior devices respond to halting and half-halting aids applied through the reins. Relying upon rein aids to halt and half-halt during practice sessions only reinforces their use when riding real horses. Riders need to practice halting and half-halting with their seat aids in order to develop an effective seat.

Except Czepiga's device, the prior art devices do not permit turns to the right or left. Riders need to practice keeping their heels down, their hands together and their seat in balance when performing turns.

BRIEF SUMMARY OF THE INVENTION

The present invention, when actuated by the rider, provides the rider with the vertical and diagonal movements transmitted from the horse's back into the rider's seat during the trot and canter. The present invention permits beginners and experienced riders to practice maintaining a balanced position while they practice applying riding aids for the purpose of improving their balanced position and strengthening their riding muscles as they post the trot or canter.

The present invention utilizes a plurality of seat supports in place of the traditional artificial horse body. The present invention includes a seat support consisting of a right side support and a left side support which represent the surface of the horse's back. The right side seat support represents the horse's back from the right shoulder to the right hip and the left side seat support represents the horse's back from the left shoulder to the left hip. The seat supports are equipped with handles for operation of the device by the rider. The seat supports have a means for containing a support dowel adjacent to said seat supports. More specifically, the seat supports rest upon a support dowel which is contained by a plurality of straps attached to the base of the seat supports. Springs are attached to both ends of the support dowel by a means for holding the ends of said springs securely to the support dowel. The opposite open end of said springs are then attached to a basic frame by a means for holding the ends of said springs securely to the basic frame. Therefore the seat supports and support dowel are suspended from the basic frame. A form representative of the horse's girth exists within the basic frame and provides resistance to pressure of the rider's legs hanging down at both sides. The device is also equipped with a means for providing foot support such as stirrups or a stirrup bar.

When the rider is mounted on the device, the rider alternately raises and lowers (in certain sequences for trot or canter) each seat support with the handles attached to said seat supports. The resulting movement created beneath the rider's seat is the alternate diagonal movement of the horse's back during the trot or canter. Additionally, when the rider presses down with his/her seat onto the seat supports and rises off the seat supports in a rhythm (i.e. posts the trot) a vertical displacement is provided by the distortion and subsequent recovery of the springs' original shape which suspend the support dowel and seat supports from the basic frame.

The advantages of the present invention are that the seat supports permit the simulation of the alternate diagonal movement in addition to the vertical movements produced in the horse's back when the horse trots or canters and therefore the present invention provides a more realistic training device for horseback riders with which to practice their riding skills.

Another advantage of the seat supports is that the rider can also give half-halting and halting aids to the device which causes the seat supports to resist movement or stop moving.

Another advantage of the seat supports are that they allow the rider to turn right or left within the boundary of the stationary frame while practicing applying turning aids as the rider posts the trot or canters.

Another advantage of the present invention is that the alternate diagonal movement is produced and controlled by the rider manipulating the seat supports by the use of the handles located at the front of the seat supports. Since the rider operates the device by manipulating the seat supports, the rider is in complete control of the trotting and cantering speeds desired.

Another advantage in connection with the handles is that they position the rider's hands in the correct "thumbs up" position and the correct distance apart from each other. The rider is able to monitor the "quietness" of his/her hands by feeling whether he/she is pushing or pulling against the handles as he/she raises and lowers them.

To overcome the shortcomings of the existing methods, the first objective of the present invention is to produce a realistic posting trot and canter movement simulator which provides the diagonal movements and vertical movements felt in a rider's seat when a horse trots or canters.

It is a further objective to provide a seat that would react to the riding aids given for half-halting and halting.

Another objective is to provide a seat that permits the rider to perform turns to the right or left, to ride facing straight ahead and also be able to ride with a "bend" while applying the aids as the rider posts the trot and canters.

A further objective is to keep the device self-operable, by the rider using the handles located at the front of each piece of the seat supports. The handles would be placed in such a way that they would position the rider's hands similarly to the way a rider would hold the reins when riding a horse.

A further objective of the present invention is to provide an exercise device which may be ridden by a child or an adult.

Another objective is to provide the device with features similar to real horseback riding which would include stirrups for the rider's feet and a horse's girth area against which the rider's calves press.

It is a further objective to make this mechanical device easy to build, constructed from common building materials, durable, and inexpensive.

The above objects as well as other objects not specifically enumerated above are accomplished by the present invention. The present hobby horse device includes a plurality of base boards, which base boards include a plurality of support posts extending upwardly at an angle from the base boards and a plurality of support beams extending horizontally between the base boards and between the support posts, which support beams contain a form comprising the horses girth, and stirrups, or in the alternative a stirrup bar which is suspended between the front support posts, a plurality of seat supports including handles attached at the front of each seat support, which seat supports have a plurality of straps attached to the bottom of each seat support, which straps encompass a support dowel which lies adjacent to and supports the seat supports, and said support dowel has a plurality of eye screws installed in both ends of said support dowel, and said eye screws hold the ends of a plurality of springs, and said springs' opposite open ends are attached to a plurality of hook screws installed into said support posts. Therefore, the seat supports and support dowel are suspended from the support posts.

BRIEF DESCRIPTION OF THE SEVERAL VIEWS OF THE DRAWINGS

The objects and advantages of the invention will become more apparent from the specification taken in conjunction with the accompanying drawings, in which:

FIG. 9 is a top view of the hobby horse device showing the range of motion of the seat supports which turn left or right.

FIG. 9A is a view from underneath showing the positioning of the straps when the seat supports are turned to the right.

DETAILED DESCRIPTION OF THE INVENTION

Figure 1:
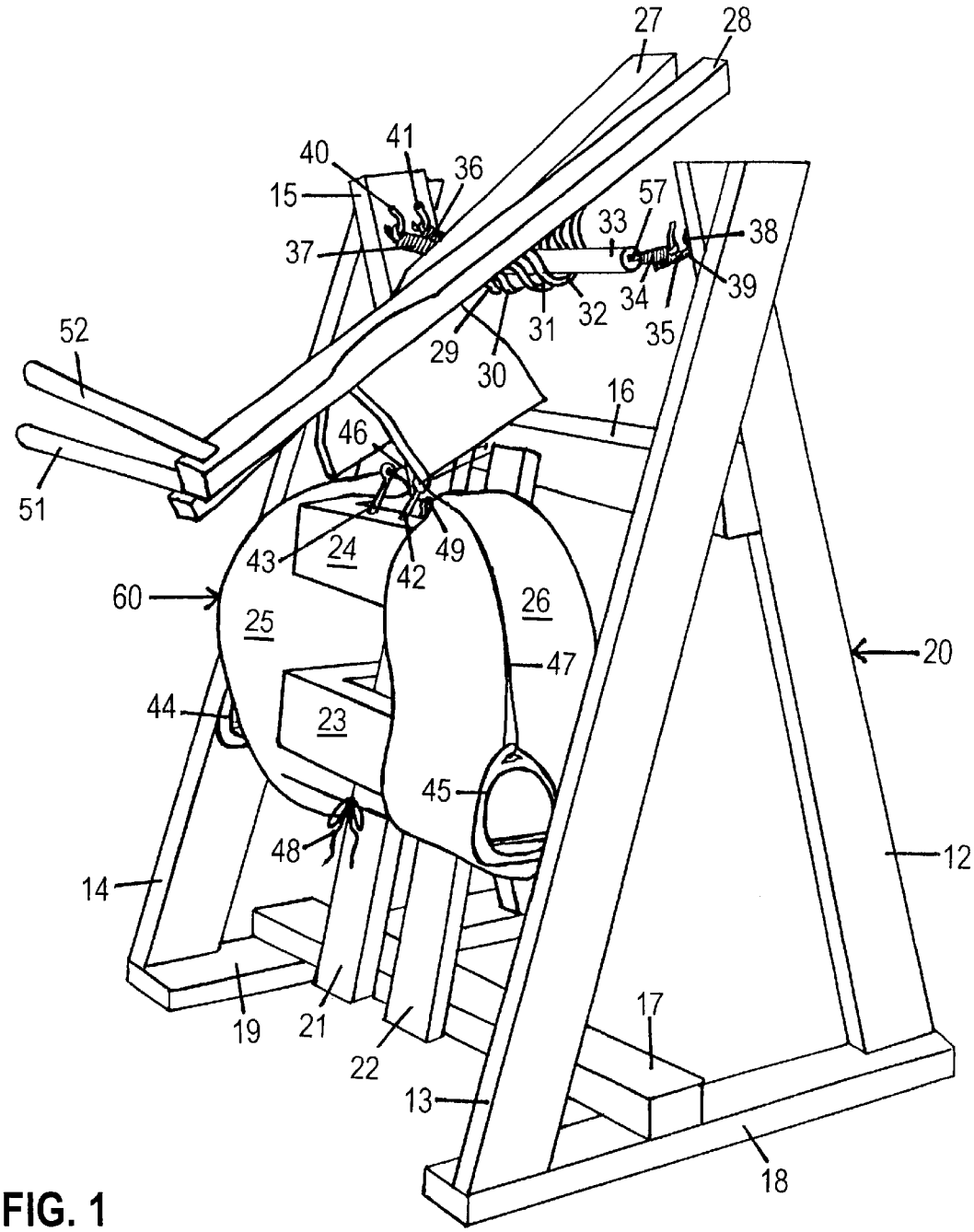
FIG. 1 is a front perspective view of the hobby horse device showing the device at rest.

Referring to the drawing shown in FIG. 1 numerals 12, 13, 14 and 15 comprise a plurality of support posts of the device which two pairs of support posts 12 & 13 and 14 & 15 are lap jointed at the top and both pairs of support posts 12 & 13 and 14 & 15 open at an angle of about 30 to 35 degrees. A support beam 16 is contoured to fit between each pair of support posts 12 & 13 and 14 & 15 near to their respective points of intersection, by having a wedge removed at each end so that support posts 13 and 14 lie flat against support beam 16. Support beam 16 is then attached to all support posts 12, 13, 14, 15. The base of both pairs of support posts 12 & 13 and 14 & 15 are then attached to a plurality of base boards 18 and 19 respectively. A support beam 17 is then attached to base boards 18 and 19 near the midpoints of the length of both base boards 18 and 19. Parts 12, 13, 14, 15, 16, 17, 18 and 19 are made from material selected from the group consisting of wood.

Numerals 12, 13, 14, 15, 16, 17, 18 and 19 represent a basic frame 20.

Figure 7:
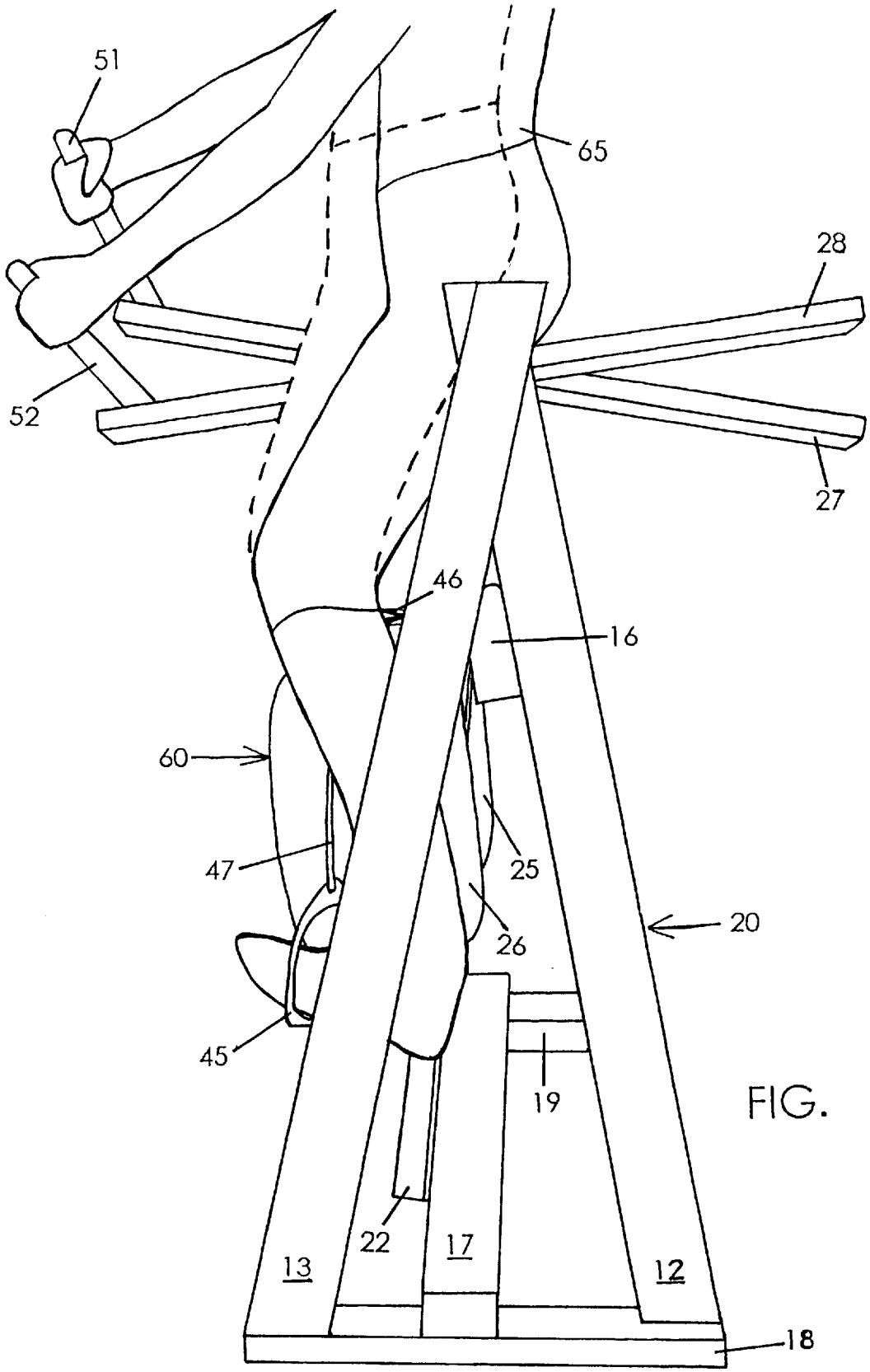
FIG. 7 is a side view of the hobby horse device with rider mounted showing the range of motion and positioning of the seat supports required to perform the posting trot.
Figure 8:
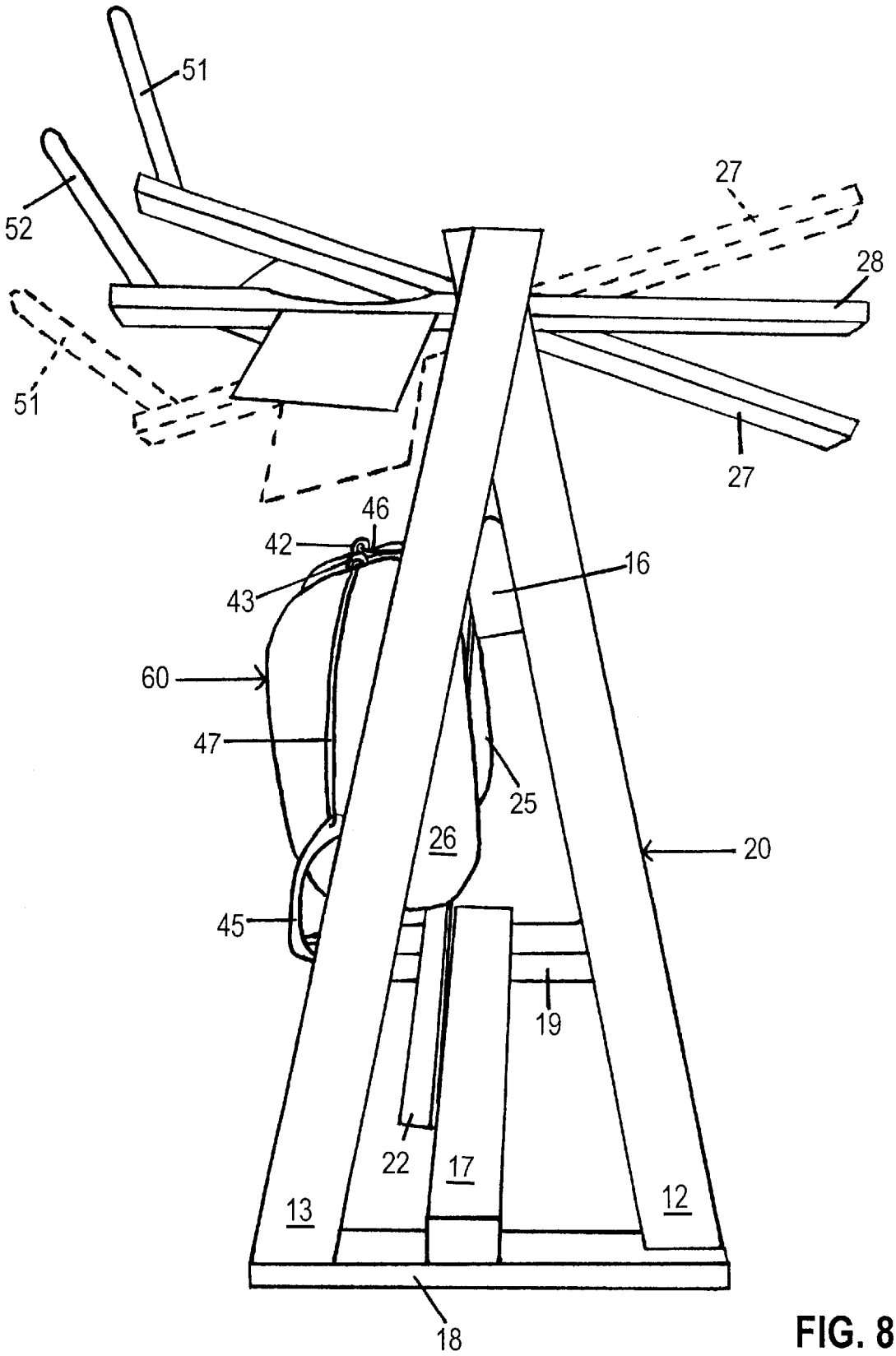
FIG. 8 is a side view of the hobby horse device showing the range of motion and positioning of the seat supports required to perform the canter.

A seat member includes a plurality of seat supports 27 and 28 which are contoured on the uppermost outer edge where the thighs of rider 65 shown in FIG. 7 rest by cutting off the outer uppermost corner. Seat supports 27 and 28 extend downward from the aforesaid contoured area approximately eight inches at an angle to support the rider's thighs. Seat supports 27 and 28 are also tapered along the inner edges for a length about seven inches from the front end and seven inches from the back end so that when seat supports 27 and 28 are being raised and lowered the right side seat support 27 and the left side seat support 28 will not interfere with each other. A plurality of handles 51 and 52 are one inch dowels which are inserted into holes drilled into the front ends of seat supports 27 and 28 at an angle as shown in FIG. 1, FIG. 7 and FIG. 8. Seat supports 27 and 28 are made from material selected from the group consisting of wood. Handles 51 and 52 are made from material selected from the group consisting of wood or metal.

The front and back ends of a plurality of straps 29, 30, 31, and 32 are attached to the underside of seat supports 27 and 28. More specifically, the front ends of straps 29, 30, 31, and 32 are attached along a line approximately half the length of seat supports 27 and 28. The resulting apertures of straps 29, 30, 31, 32, lie next to each other in a row as shown. Straps 29 and 30 are attached to the underside of seat support 27 and straps 31 and 32 are attached to the underside of seat support 28. Straps 29, 30, 31 and 32 are made from material selected from the group consisting of metal.

A plurality of hook screws 38, 39, 40, and 41 are installed at an equal height in the lap joints of support posts 12 & 13 and 14 & 15 as shown. Hook screws 38 and 39 are spaced approximately two inches apart and hook screws 40 and 41 are spaced approximately two inches apart. Hook screws 38, 39, 40 and 41 are approximately two and one-half inches long and made from material selected from the group consisting of metal.

Figure 2:
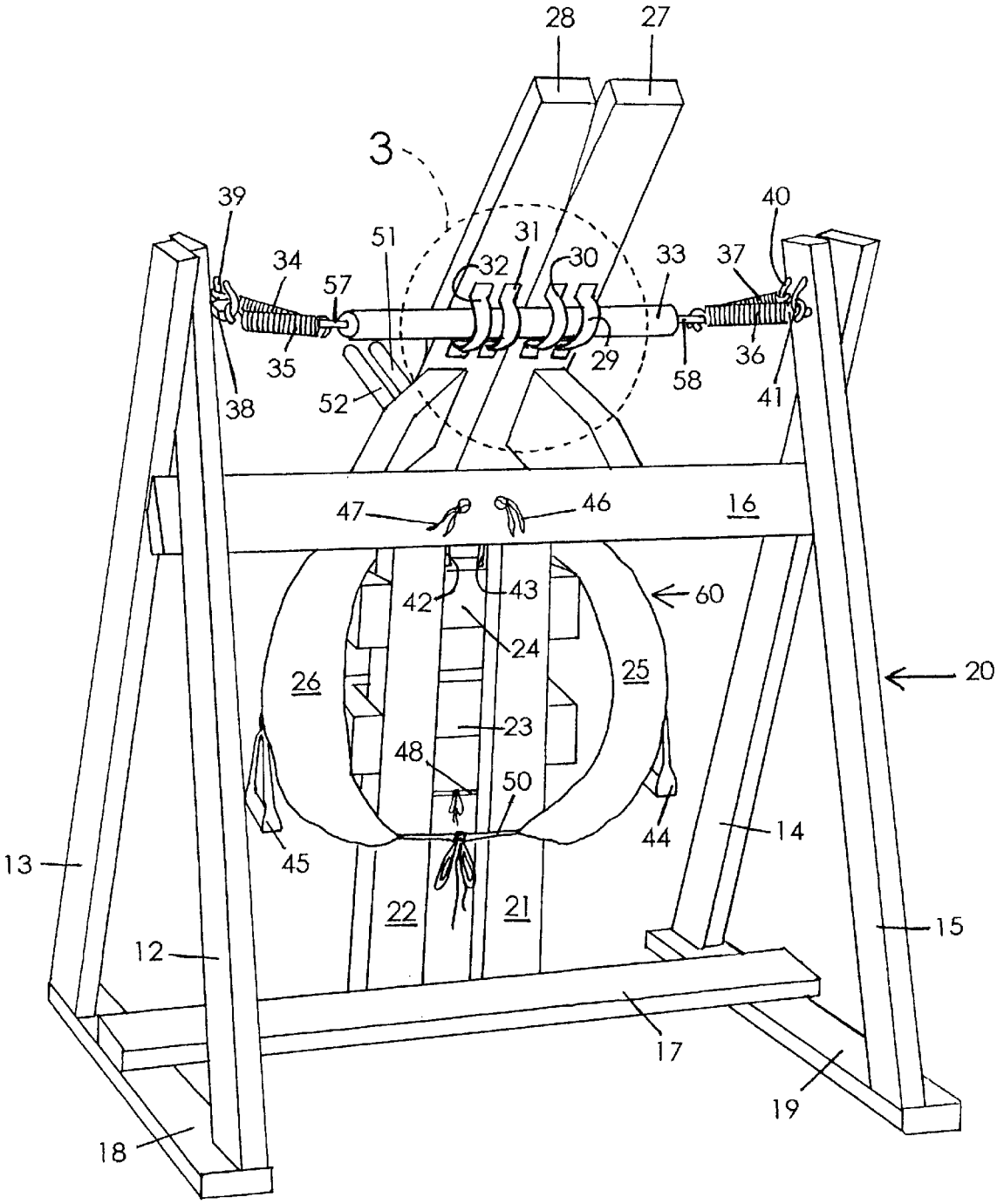
FIG. 2 is a rear perspective view of the hobby horse device showing the device at rest.

A support dowel 33 is approximately one and one-quarter inches in diameter and has a plurality of eye screws 57 and 58 shown in FIG. 2 installed into both ends. Eye screw 57 is installed into one end of support dowel 33 and eye screw 58 is installed into the opposite end of support dowel 33. Support dowel 33 is made from material selected from the group consisting of wood. Eye screws 57 and 58 are approximately three inches long and made from material selected from the group consisting of metal.

A plurality of springs 34, 35, 36 and 37 are open ended coil springs about four inches long and about three-quarter inches wide. One end of both springs 34 and 35 is attached to hook screws 39 and 38 respectively. The remaining open ends of springs 34 and 35 are then attached to eye screw 57. Springs 34, 35, 36 and 37 are made from material selected from the group consisting of metal.

Support dowel 33 is threaded through the apertures formed by straps 32, 31, 30, 29 and seat supports 27 and 28. Eye screw 58 shown in FIG. 2 is connected to one end of both springs 36 and 37 and the remaining open ends of springs 36 and 37 are then connected to hook screws 41 and 40 respectively.

Figure 3:
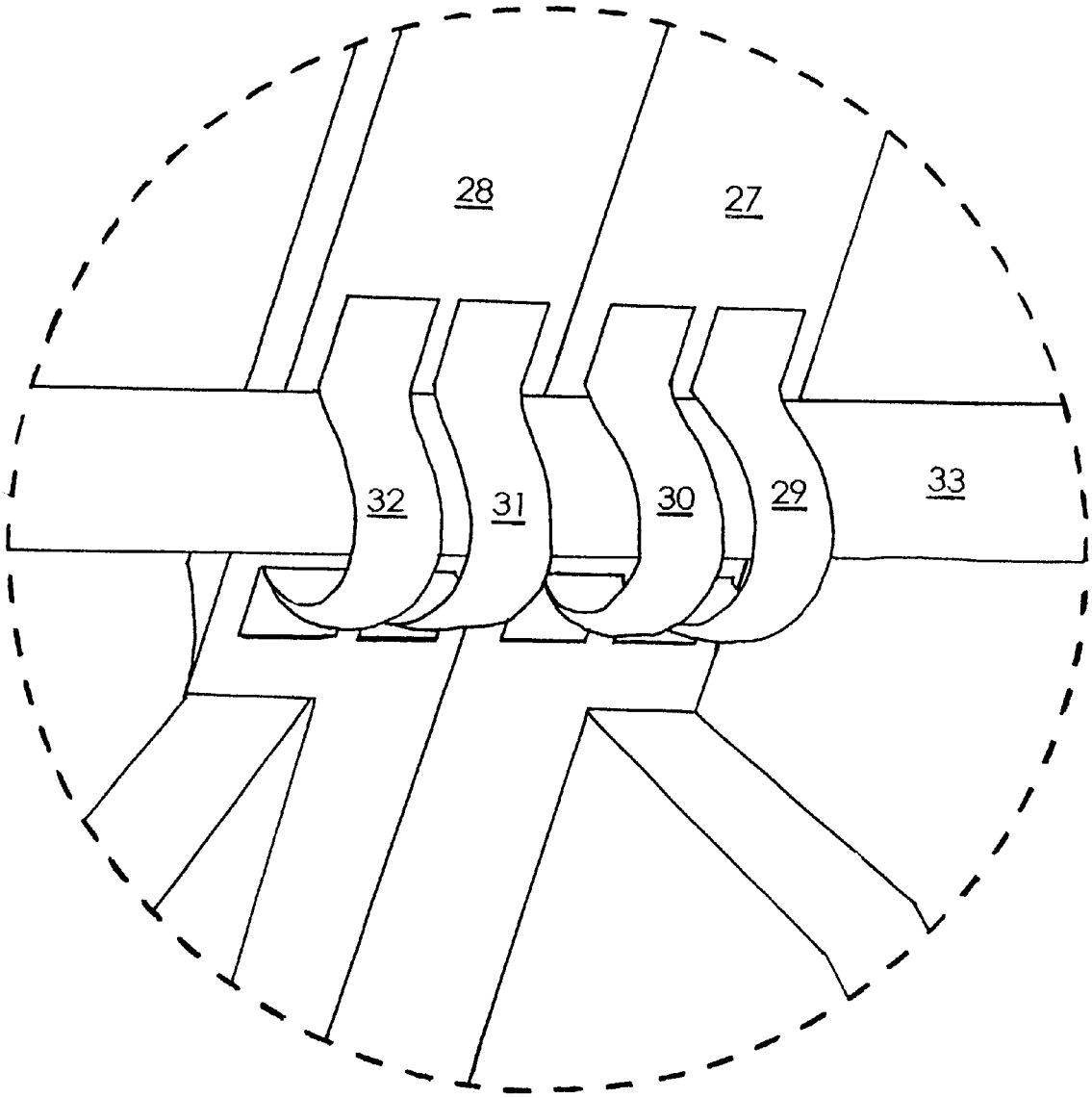
FIG. 3 is an enlarged view of the four straps which encompass the support dowel.

A plurality of backing boards 21 and 22 are attached to the front of support beam 16 and the front of support beam 17. A box framework consisting of 24 and 23 is added to provide a foundation for a horse's girth 60. A plurality of padded forms 25 and 26 cover the outer surface of box framework 23 and 24. Padded forms 25 and 26 are secured around box framework 23 and 24 with a plurality of ties 48 and 49 and a tie 50 in the lower rear which is shown in FIG. 3. Numerals 21, 22, 23, 24, 25, 26, 48, 49 and 50 represent the horse's girth 60. Backing boards 21 & 22 and box framework 23 & 24 are made from material selected from the group consisting of metal, plastic or wood. Padded forms 25, 26, and ties 48, 49 and 50 are made from materials selected from the group consisting of textiles and fibers.

A plurality of stirrup ropes 46 and 47 are threaded through the apertures located at the top of a plurality of stirrups 44 and 45 respectively. The loose ends of stirrup ropes 46 and 47 are brought evenly together and threaded through the respective eye screws 43 and 42 which are installed in box framework 24 and then threaded through holes drilled through support beam 16 where the ends of stirrup ropes 46 and 47 are finally secured with overhand knots. The stirrup ropes 46 and 47 can be lengthened or shortened to accommodate riders of differing heights. Stirrups 44 and 45 are made from material selected from the group consisting of metal. Stirrup ropes 46 and 47 are made from material selected from the group consisting of fiber. Eye screws 43 and 42 are approximately three inches long and are made from material selected from the group consisting of metal.

FIG. 2 shows more clearly from the back of the device tie 50 that further secures padded forms 25 and 26 around horse's girth 60. Stirrup ropes 46 and 47 are shown secured with overhand knots in the back of support beam 16. Eye screw 58 is also represented on support dowel 33. Box framework 23 and 24 is more clearly depicted in its manner of attachment to backing boards 21 and 22 in that box framework 23 and 24 encloses backing boards 21 and 22.

FIG. 3 shows an enlarged view of straps 29, 30, 31, 32 which contain support dowel 33 and which are attached to the underside of seat supports 27 and 28. Straps 29, 30, 31, 32 have a diameter from front to back that is greater than the diameter of support dowel 33. The space intervening between support dowel 33 and straps 29, 30, 31, and 32 forms an aperture which allows for sideways turning of the seat supports 27 and 28. As depicted in FIG. 3 the apertures of straps 29, 39, 31 and 32 lie next to each other in a row. The front edge of straps 29, 30, 31 and 32 lie along the line that divides the length of the seat supports 27 and 28 approximately in half. Straps 29, 30, 31 and 32 are parallel to each other.

Figure 4:
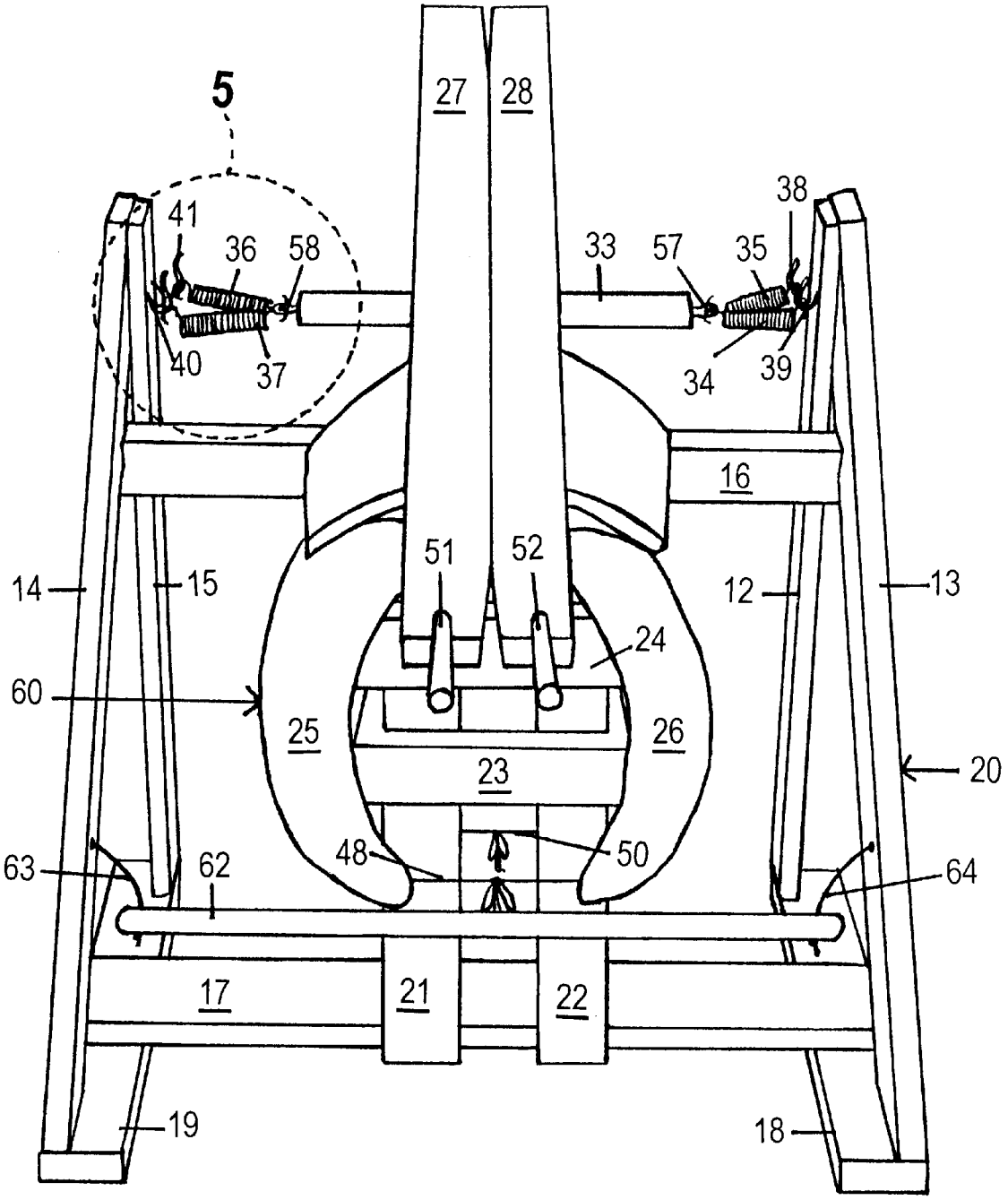
FIG. 4 is a front view of the hobby horse device showing an alternate stirrup bar.

FIG. 4 shows the device from the front with seat supports 27 and 28 in their pre-mount position. FIG. 4 shows a stirrup bar 62 which is connected to support posts 13 and 14 by a plurality of stirrup bar ropes 63 and 64. Stirrup bar ropes 63 and 64 are threaded through separate holes drilled through both ends of stirrup bar 62 and secured by overhand knots on the underneath of stirrup bar 62. The free ends of stirrup bar ropes 63 and 64 are threaded through separate holes drilled through support posts 13 and 14 and secured on the outside surface of support posts 13 and 14 by overhand knots. Stirrup bar ropes 63 and 64 can be shortened or lengthened to accommodate riders of differing heights. Stirrup bar 62 is an alternate foot hold and replaces the need for stirrups 44 and 45, eye screws 42 and 43, and ropes 46 and 47. Stirrup bar 62 is recommended for beginner riders or novice riders because should the rider 65 lose his or her balance the rider's foot can easily step down off the device and then the rider 65 can readily remount. Stirrup bar 62 is made from material selected from the group consisting of wood. Stirrup bar ropes 63 and 64 are made from material selected from the group consisting of fiber.

Figure 5:
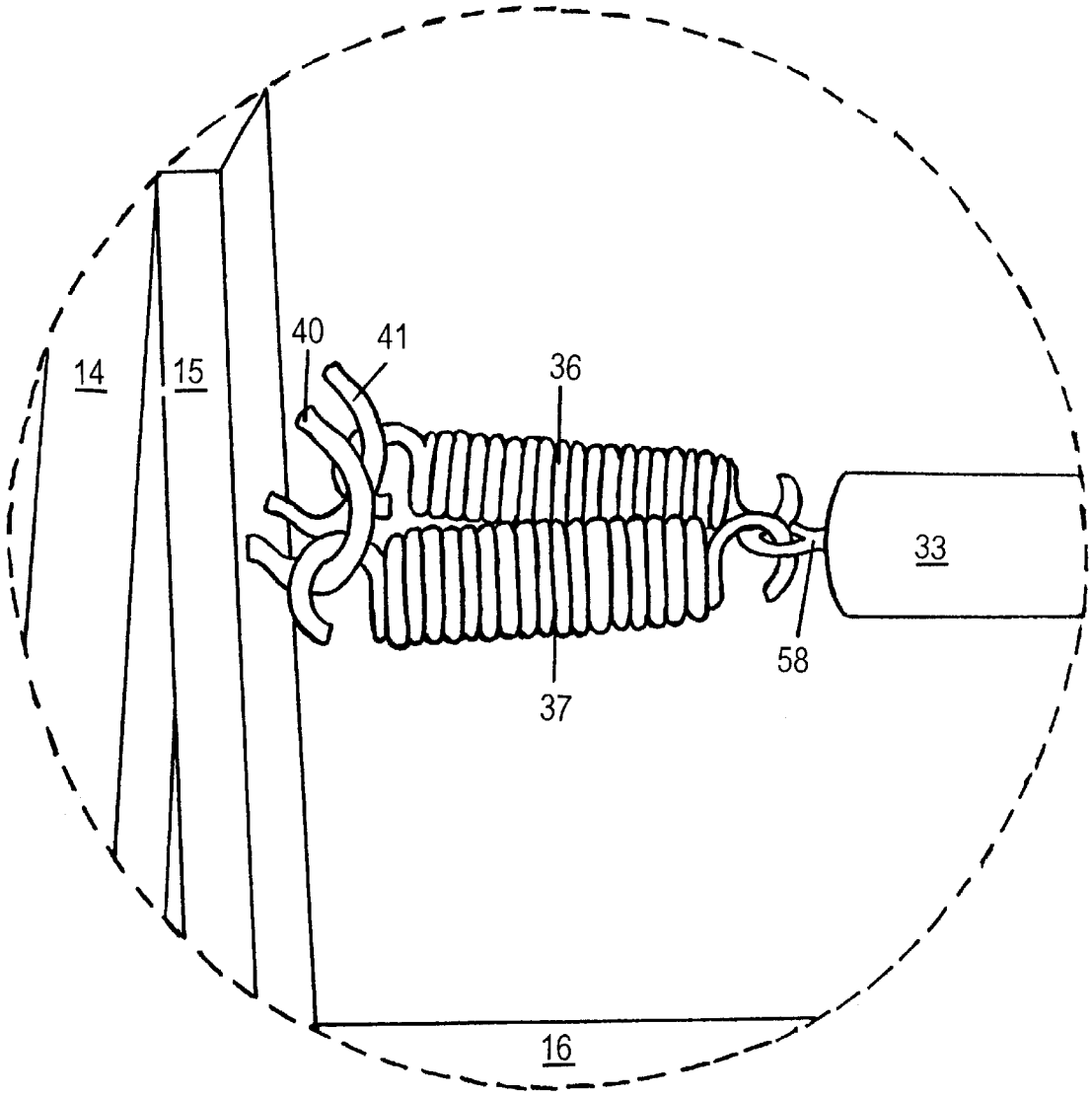
FIG. 5 is an enlarged view showing the method of attaching the support dowel to the basic frame using eye screws, springs, and hook screws.

FIG. 5 shows an enlargement of the attachment of eye screw 58 to springs 36 and 37 and springs 36 and 37 attachment to hook screws 41 and 40 respectively.

Figure 6:
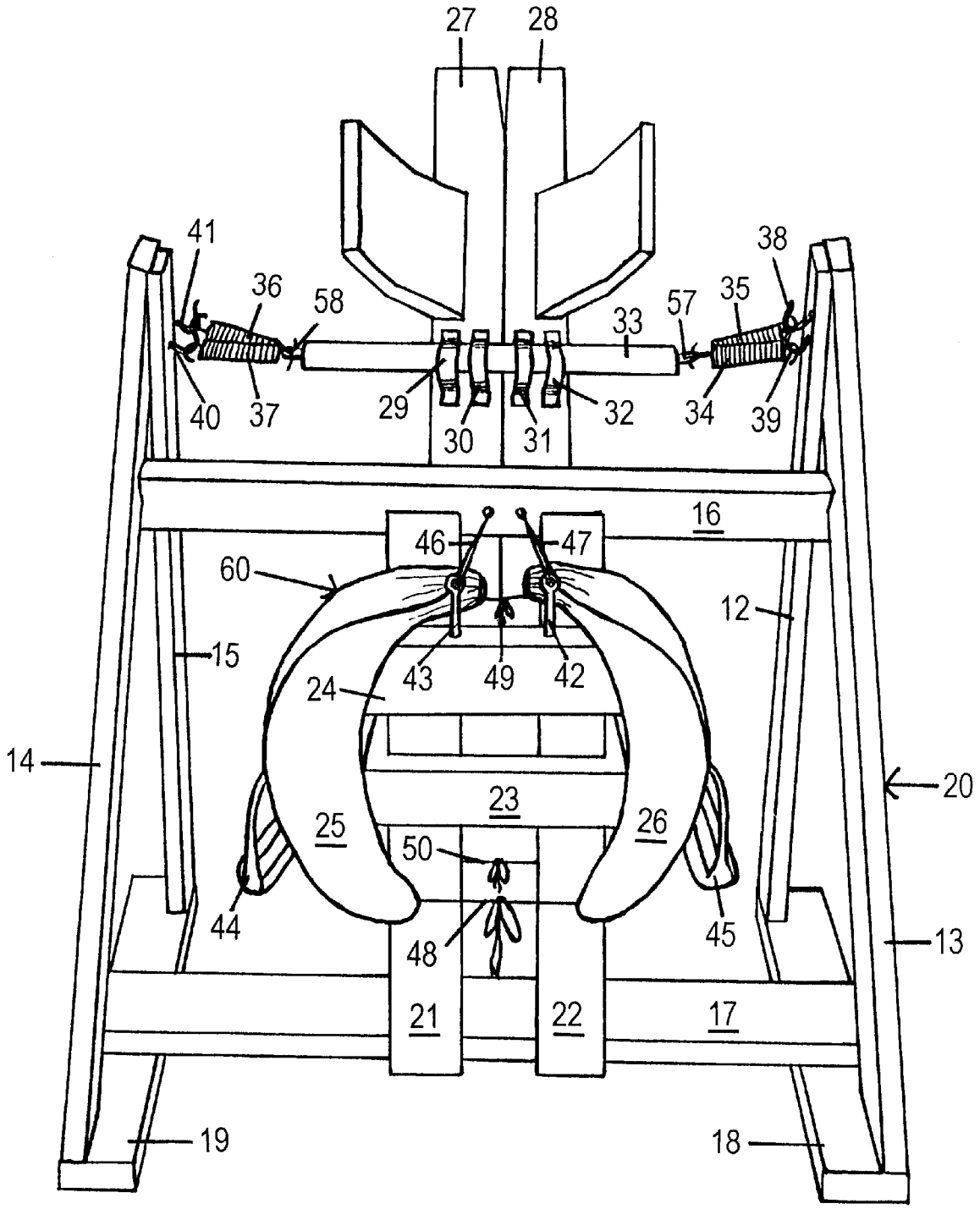
FIG. 6 is a front view showing the hobby horse device with the seat supports in an alternate rest position.

FIG. 6 shows seat supports 27 and 28 in their furthest position to the rear which allows a clearer view of the stirrup ropes 46 and 47 passage through eye screws 43 and 42 and their further passage through the holes drilled through support beam 16. Tie 49 securing padded forms 25 and 26 is more clearly depicted.

FIG. 7 shows the device with seat supports 27 and 28 being manipulated to the maximum required displacement to simulate the diagonal movement of the posting trot. The rider 65 is shown sitting in solid lines and rising in broken lines.

FIG. 8 shows seat supports 27 and 28 being manipulated to show the maximum displacement required of seat supports 27 and 28 to perform the canter movement. The solid lined and broken lined image of seat support 27 shows the maximum displacement for the canter. Seat support 28 and seat support 27 (in solid lines) shows the point where the seat support 28 commences following the movements of seat support 27.

FIG. 9 shows the range of motion of seat supports 27 and 28 for sideways turning to the right (solid lines) and left (broken lines.)

FIG. 9A shows the space intervening between support dowel 33 and straps 29, 30, 31, and 32 which allows for sideways movements of seat supports 27 and 28.

The hobby horse device of the above construction is operated as follows. Mounted, a rider 65 straddles the seat supports 27 and 28, and places both feet in the stirrups 44 and 45, or in the alternative on stirrup bar 62. The rider's calves contact the horse's girth 60, and the rider's hands take hold of both handles 51 and 52. It is recommended that rider 65 stand up in the stirrups 44 and 45 or stirrup bar 62 (with weight down into heels) in a two point position to find a balanced position and then lower himself or herself onto the seat supports 27 and 28. Stirrup ropes 46 and 47, or stirrup bar ropes 63 and 64 will become taut and should remain taut throughout the exercise/practice session.

The posting trot can be practiced by rider 65 pressing down on the seat supports 27 and 28 with his/her seat and rising with his/her seat in a rhythm that is comfortable. The springs 34, 35, 36 and 37 which suspend the support dowel 33, and seat supports 27 and 28 from the basic frame 20 (by their attachment to hook screws 38, 39, 40, 41 and eye screws 57 and 58) provide the vertical movement by extending when rider 65 presses down with his/her seat and by returning to their original shape when rider 65 rises off the seat. Once rider 65 is in balance with this vertical movement of posting, the diagonal movement can be added by alternately raising and lowering the seat supports 27 and 28. Both seat supports 27 and 28 rest upon a support dowel 33 which acts as a fulcrum and the seat supports 27 and 28 act as levers which turn independently around the support dowel 33. When rider 65 raises and lowers the seat supports 27 and 28 with handles 51 and 52 in an alternating manner, a diagonal movement is produced beneath the riderts seat.

This device allows rider 65 to determine which diagonal he/she is posting to because each time rider 65 rises, the same seat support 27 or 28 will be in the down position. Rider 65 can easily practice changing diagonals. Rider 65 will also be able to determine which direction the horse is prepared to turn.

Turning is accomplished by rider 65 opening his/her shoulder in the direction rider 65 wishes to turn. Seat supports 27 and 28 will turn in that direction because when rider 65 opens his/her shoulder the rider's pelvis also turns in that direction and seat supports 27 and 28 are pushed by the rider's outside leg in the direction of the turn. During turns, the seat supports 27 and 28 slide diagonally across the surface of the support dowel 33 causing the support dowel 33 to occupy diagonally the space existing between the support dowel 33 and the straps 29, 30, 31, 32.

Half-halting and halting can be practiced on the present invention by rider 65. Rider 65, while posting the trot or cantering must squeeze the seat supports 27 and 28 together with his/her thighs and sit down firmly for a stride until the seat supports 27 and 28 resist movement due to the friction between seat supports 27 and 28. To half-halt rider 65 must hold the squeeze of the seat supports 27 and 28 for a short time, possibly half a stride, and then resume posting or cantering. To halt, rider 65 continues to squeeze the seat supports 27 and 28 together and sit down firmly until rider 65 can no longer raise and lower the seat supports 27 and 28.

Cantering will be simulated when rider 65 raises and lowers the seat supports 27 and 28 in a certain pattern. Rider 65 should raise one seat support, for instance seat support 27. When seat support 27 is at it's required height rider 65 will begin to raise the other seat support 28 and from that point on the seat supports 27 and 28 will continue being raised and lowered at a continuous speed and rhythm in a following motion. The rider's seat will maintain contact with seat supports 27 and 28 during the canter movement. The seesawing movement and diagonal movement produced by the manipulation of the seat supports 27 and 28 in combination with rider 65 sitting and pressing down with his/her seat rhythmically for the vertical movements creates a realistic feeling canter movement.

The trot, canter, turning, halting and half-halting can also be ridden by rider 65 in the two point position with satisfactory simulation of horse movements.

This hobby horse device provides a realistic horse movement in which rider 65 is able to practice applying all leg aides while posting the trot, cantering, turning, half-halting and halting so that rider 65 can strengthen the appropriate muscles required for riding in the sport of horseback riding. Since this device is actuated by rider 65, rider 65 is in complete control of the gaits sought and their respective speeds. Transitions up to trot and canter and down to trot and halt can also be practiced to improve balance. This device also allows rider 65 to monitor the "quietness" of his/her hands by noting when he/she is pulling or pushing on the handles as he/she raises and lowers them.

Thus the reader will see that the present invention provides an effective exercise and practice device for horseback riders which is sturdy, easy to operate, inexpensive and which can be ridden by persons of almost any age.

The principles, a preferred embodiment and the mode of operation of the present invention have been described in the foregoing specification. However, the invention which is intended to be protected is not to be construed as limited to the particular embodiment disclosed. The embodiment is therefore to be regarded as illustrative rather than restrictive. Variations and changes may be made by others without departing from the spirit of the invention. For example the present invention could consist solely of seat supports 27 and 28, support dowel 33, straps 29, 30, 31, 32, eye screws 57 and 58, springs 34, 35, 36 and 37 and hook screws 38, 39, 40, 41 and simply be attached to and suspended between any door frame. With this embodiment the rider would use the floor surface for the foot support. Or, seat supports 27 and 28 could have handles 51 and 52 attached on the back of seat supports 27 and 28 so that the device could be operated for the rider by another person and the rider could practice riding hands free. Or, seat supports 27 and 28 could have an opening drilled horizontally through their thickness which would accommodate support dowel 33 and hold support dowel 33 adjacent to seat supports 27 and 28. Further, this device could use the alternate stirrup bar 62 and omit the horse's girth 60 altogether. Additionally, the basic frame 20, box framework 23 and 24, backing board 21 and 22, seat supports 27 and 28, handles 51 and 52, and/or support dowel 33, could be constructed out of various other materials such as metal, and the sizes and shapes could vary. Additionally, it will be understood that other materials may be used advantageously for the horse's girth, as, for example, parts may be molded of suitable plastic materials or weight-bearing components may be made of or reinforced with metal. For mass production, molded plastic parts offer the advantage of combining a number of adjacent parts in single units rather than individual components which must later be joined together.

Accordingly, it is expressly intended that all such equivalents, variations and changes which fall within the spirit and scope of the present invention as defined in the claims be embraced thereby. Accordingly, the scope of the invention is determined by the claims and their legal equivalents.

REFERENCE NUMBERS

12 support post
13 support post
14 support post
15 support post
16 support beam
17 support beam
18 base board
19 base board
20 basic frame
21 backing board
22 backing board
23 box framework
24 box framework
25 padded form
26 padded form
27 seat support
28 seat support
29 strap
30 strap
31 strap
32 strap
33 support dowel
34 spring
35 spring
36 spring
37 spring
38 hook screw
39 hook screw
40 hook screw
41 hook screw
42 eye screw
43 eye screw
44 stirrup
45 stirrup

46 stirrup rope
47 stirrup rope
48 tie
49 tie
50 tie
51 handle
52 handle
57 eye screw
58 eye screw
60 horse's girth
62 stirrup bar
63 stirrup bar rope
64 stirrup bar rope
65 rider

I claim:

1. A hobby horse comprising:

(a) a basic frame, (b) a seat member consisting of a right side support and a left side support, (c) a plurality of handles attached to said supports, (d) a support dowel, (e) means for containing and holding said support dowel adjacent to said seat member and said means have a diameter that is greater than the diameter of said support dowel, (f) a plurality of springs, (g) means for attaching said springs between said support dowel and said basic frame so as to suspend said support dowel and said seat member above the ground, (h) means for providing foot support.

2. A hobby horse comprising:

(a) a basic frame, (b) a seat member consisting of a right side support and a left side support, (c) a plurality of handles attached to said supports, (d) a support dowel, (e) a plurality of straps for containing and holding said support dowel adjacent to said seat member, said straps have a diameter that is greater than the diameter of said member dowel and said straps are attached to the underside of said seat support, (f) a plurality of springs, (g) means for attaching said springs between said support dowel and said basic frame so as to suspend said support dowel and said seat member above the ground, (h) a form representing the horse's girth which exists within said basic frame, (h) means for providing foot support.

3. A hobby horse comprising:

(a) a basic frame, (b) a plurality of seat supports, (c) a plurality of handles attached to said seat supports, (d) a support dowel, (e) a plurality of straps attached to base of said seat supports which encompass said support dowel and hold said support dowel adjacent to said seat supports, (f) a plurality of eye screws installed in both ends of said support dowel, (g) a plurality of hook screws installed in said basic frame, (h) a plurality of springs having one end of said springs connected to said plurality of hook screws installed in said basic frame and the other end of said springs attached to said eye screws installed in said support dowel, (i) a form representing the horse's girth which exists within said basic frame, (j) means for providing foot support.

* * * * *